United States Patent [19]

Slaughter

[11] Patent Number: 4,466,561

[45] Date of Patent: Aug. 21, 1984

[54] BELT BUCKLE KNIFE

[75] Inventor: Richard L. Slaughter, Texarkana, Ark.

[73] Assignee: Slaughter Knife Co., Inc., Texarkana, Ark.

[21] Appl. No.: 389,620

[22] Filed: Jun. 18, 1982

[51] Int. Cl.[3] ..... A45C 15/00

[52] U.S. Cl. ..... 224/163; 30/155; 206/38; 206/349; 24/163 K; 224/232

[58] Field of Search ..... 206/38, 349; 224/163, 224/232; 24/163 K, 163 R; 30/155, 156; 7/118, 158

[56] References Cited

U.S. PATENT DOCUMENTS

| | | | |
|---|---|---|---|
| 1,810,031 | 6/1931 | Schrade | 30/159 |
| 2,736,959 | 3/1956 | Simon et al. | 30/155 X |
| 2,982,454 | 5/1961 | Wolberg | 7/158 X |
| 3,009,245 | 11/1961 | Senkewitz | 30/155 |
| 3,823,421 | 7/1974 | Collins | 2/321 |
| 3,823,422 | 7/1974 | Forgett, Jr. | 2/321 |
| 3,885,250 | 5/1975 | Schiller | 2/321 |
| 4,078,272 | 3/1978 | Mahon | 7/118 X |
| 4,096,979 | 6/1978 | Collins | 224/26 |
| 4,100,655 | 7/1978 | Langley | 24/163 |
| 4,190,953 | 3/1980 | Naifeh | 30/155 |
| 4,209,117 | 6/1980 | Corinaldi et al. | 24/163 K X |
| 4,313,230 | 2/1982 | Chovaniec | 224/232 X |
| 4,389,775 | 6/1983 | Collins | 224/163 X |

*Primary Examiner*—Allan N. Shoap
*Assistant Examiner*—Robert Petrik
*Attorney, Agent, or Firm*—Arnold, White & Durkee

[57] ABSTRACT

A belt buckle knife is disclosed in which a knife portion can be removed with the knife blade locked in its open position without the need of removing the belt buckle knife from the belt. The belt buckle knife includes a buckle portion which engages and fastens the belt independent of the knife portion being attached to or removed from the buckle portion. The knife portion is selectively operable from a knife closed position to a knife open position. In the knife closed position, the knife blade is engaged by a part of the buckle portion, with the knife portion and the buckle portion being securely fastened together. In the knife open position, the knife blade is locked open with respect to the knife handle, and the knife portion can readily be removed from the buckle portion.

6 Claims, 3 Drawing Figures

BELT BUCKLE KNIFE

BACKGROUND OF THE INVENTION

This invention relates generally to knives, and more particularly to a belt buckle and knife combination.

The knife is a tool long used and known by man. It is a favored tool of outdoorsmen, and is used for many tasks, both in and out-of-doors.

Numerous knives have been designed to accommodate varying needs and tastes. Long known is the straight knife which can be accommodated by a sheath worn on a belt. The straight knife has the advantage of being in an open position when withdrawn from its sheath. It has the disadvantage, however, of catching on to underbrush, tree branches and the like in the woods, and of getting in the way when its wearer is seated, for example, in a car.

Folding knives have been designed which can be carried either in a pocket or in a knife case worn on a belt. While roughly half the size of a straight knife when in its closed position, the folding knife can result in a rather large mass in a pocket, which can lead to discomfort when seated. And, while the belt worn knife case is smaller than the belt worn straight knife sheath, it is still of sufficient size to catch underbrush and branches in the woods. The folding knife has the disadvantage of being closed when it is removed from a pocket or from a knife case, thereby requiring an operation in addition to withdrawing the knife from the pocket or knife case to place the knife blade in an open and usable position.

Belt buckle knives have been developed to alleviate the foregoing problems experienced with straight blade knives and folding knives. In most of the known prior art belt buckle knives, however, the knife forms an essential part of the buckle. To use the knife, the belt must first be unfastened and the buckle/knife combination then taken apart. Such prior art devices have the distinct disadvantage that the buckle and belt must be unfastened to use the knife portion of the combination belt buckle/knife.

Other known prior art devices include a belt buckle member and a knife member. The belt buckle member fastens the belt and maintains the belt in the fastened position, even after the knife member is removed. In such known devices, however, the knife member is of the folding knife variety and must be opened by a separate operation after the knife member is removed from the belt buckle member.

Thus there is a need for a belt buckle knife in which a knife member is removed with its blade in an open, locked position, and in which the buckle portion maintains the belt in its fastened, secured position, even after the knife portion is removed.

SUMMARY OF THE INVENTION

According to the present invention, a belt buckle knife is provided. Specifically, the present invention provides a belt buckle knife having a buckle structure which engages and fastens a belt, and a knife structure removably accommodated by the buckle structure. The buckle and knife structures cooperate with each other so that when the knife structure is in a closed position, the knife structure and buckle structure are locked to each other; and when the knife structure is in an open position, it can be removed from the buckle structure with the knife blade locked in an open position.

According to one aspect of the invention, the knife structure is provided with a blade member and a handle member. The blade member is provided with a blade portion and a tang portion having a blade member recess. The handle member is provided with a locking arm having a detent. The detent engages the blade member recess to lock the blade member in its open position.

According to another aspect of the invention, the buckle structure includes a blade receiving region and a handle receiving region having a handle receiving recess. When the knife structure is in its closed position, the blade receiving region engages the blade member, the handle receiving region engages the handle member, and the detent of the locking arm engages the handle receiving recess locking the knife structure and the buckle structure together.

BRIEF DESCRIPTION OF THE DRAWINGS

The invention will further be described by reference to the accompanying drawings which illustrate a particular embodiment of a belt buckle knife in accordance with the present invention, wherein like members bear like reference numerals and wherein.

DESCRIPTION OF THE PREFERRED EMBODIMENT

Figure 1:
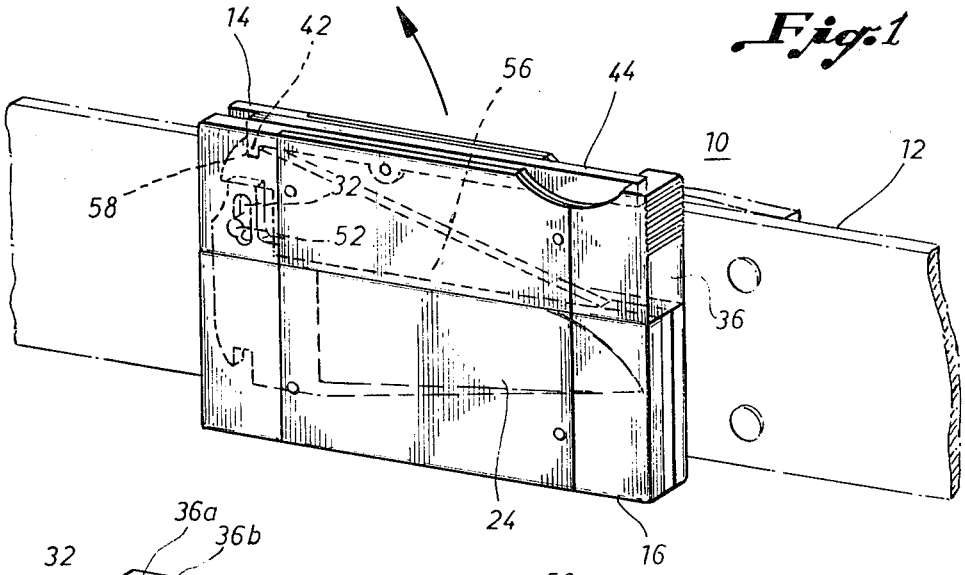
FIG. 1 is a perspective view of a belt buckle knife in accordance with the present invention shown in place on a belt.

Referring now to the drawings, and in particular to FIG. 1, there is shown in perspective view a belt buckle knife 10 attached to a belt 12. The belt buckle knife 10 includes a knife portion 14 and a buckle portion 16. In the embodiment illustrated, the knife portion 14 is the upper portion of the belt buckle knife 10, and the buckle portion 16 is the lower portion. The relative location of one portion with respect to the other, however, is not critical.

Figure 2:
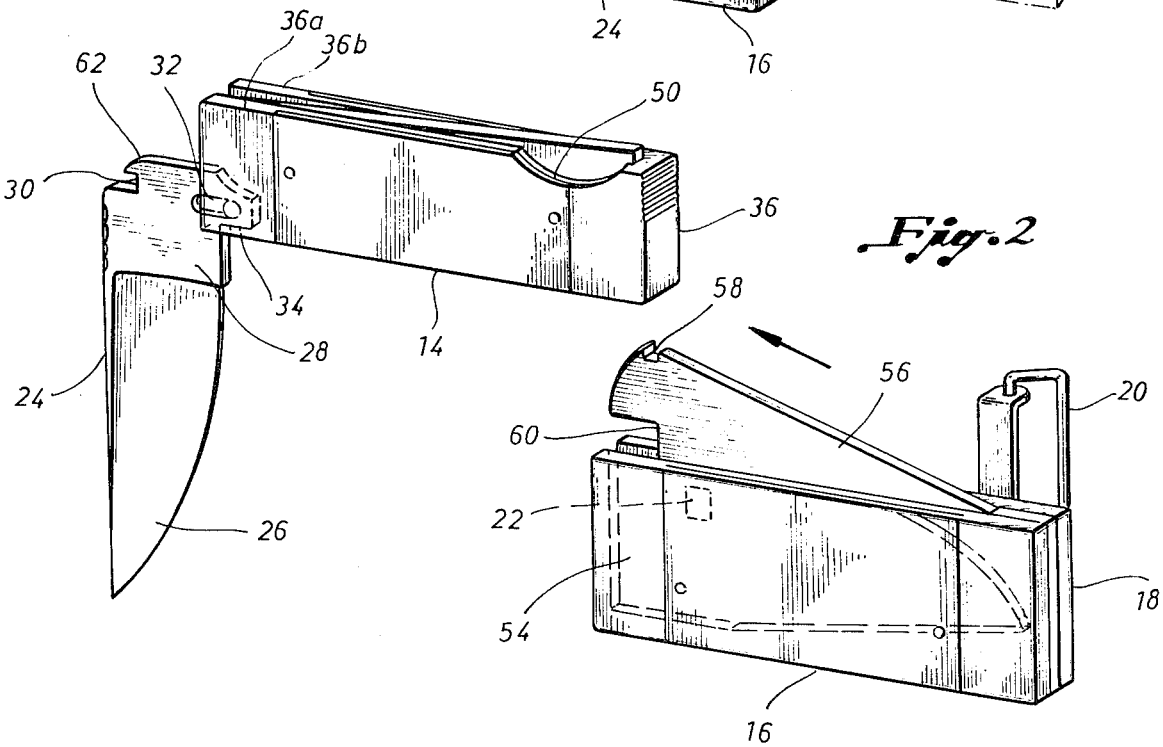
FIG. 2 is a perspective view of the knife portion and the buckle portion of the belt knife illustrated in FIG. 1.

Referring now to FIGS. 1 and 2, the buckle portion 16 includes a rear flat face 18 on which a belt receiving loop 20 and a belt hook 22 are disposed. The belt receiving loop 20 accommodates the conventional buckle end of the belt 12. To close and fasten the belt, the belt hook 22 is made to engage one of the conventional apertures on the belt 12. Thus the buckle portion 16 of the belt buckle knife 10 performs all the functions typically performed by a conventional belt buckle.

With continued reference to FIG. 2, the knife portion 14 includes a blade member 24 having a blade portion 26 and a tang portion 28. The tang portion 28 includes a blade member recess 30, a blade member slot 32 and a blade member shoulder 34.

Figure 3:
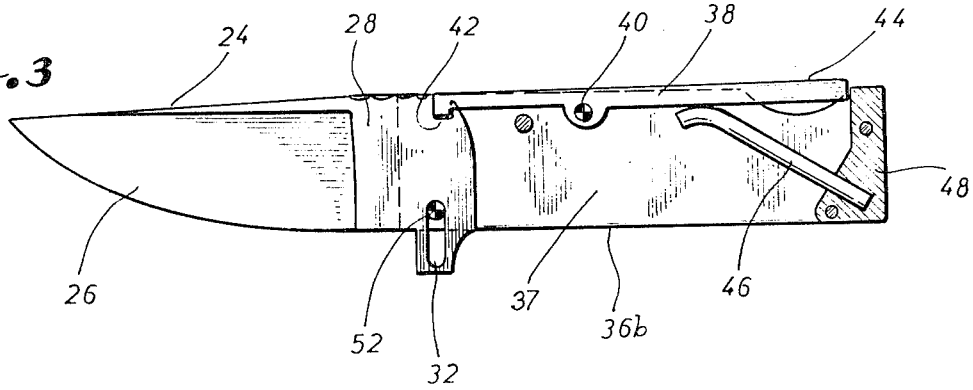
FIG. 3 is a partial section view of the knife portion of the belt buckle knife illustrated in FIG. 1 with the knife blade locked in its open position.

Referring to FIGS. 2 and 3, the knife portion 14 further includes a handle member 36 having first and second handle face elements **36*a*, 36*b* and a locking arm 38 pivotally mounted on a pivot pin 40. The first handle face element 36*a* is spaced from the second handle face element 36*b* by a distance approximately equal to the width of the locking arm 38; the first and second handle face elements 36*a*, 36*b* and the locking arm 38 define a slot-like region 37. The locking arm includes a detent 42** disposed at one end of the locking arm 38, and a thumb depressing region 44 located at the other end. A bias spring 46 mounted in a handle butt 48 urges the locking member 38 pivotally about the pivot pin 40. Pressure applied at the thumb depressing region 44 of the locking arm 38 tends to overcome the biasing force of the bias spring 46. The handle member 36 includes a thumb recess 50 to facilitate depressing the thumb depressing region 44.

The handle member 36 further includes a pivot pin 52 on which the blade member 24 is mounted. The pin 52 engages the blade member slot 32. When the blade member 24 is in the locked open position illustrated in FIG. 3, the detent 42 of the locking arm 38 engages the blade member recess 30. The detent 42 is urged into and maintained in engagement with the recess 30 by the biasing force exerted by the biasing spring 46. To unlock the blade, the thumb depressing region 44 of the locking arm 38 is depressed, thereby causing the detent 42 to pivot out of engagement with the blade member recess 30.

FIG. 1 illustrates the knife portion 14 in a closed position with the knife portion 14 and the buckle portion 16 locked together. Referring to FIGS. 1 and 2, the buckle portion 16 includes a blade receiving region 54 which engages the blade member 24. The buckle portion 16 further includes a handle receiving region 56 having a handle receiving recess 58 and a handle receiving region shoulder 60. When in the closed locked position, the blade member 24 of the knife portion 14 engages the blade receiving region 54 of the buckle portion 16, the handle slot-like region 37 of the member 36 engages the handle receiving region 56, the blade member shoulder 34 abuts the handle receiving region shoulder 60, and the detent 42 of the locking arm 38 engages the handle receiving recess 58.

In operation, the belt buckle knife 10 engages and fastens the belt 12 about the wearer's waist. To remove the knife portion 14 from the belt buckle knife 10, the wearer depresses the thumb depressing region 44 and pivots the handle member 36 in the direction of the arrow illustrated in FIG. 1. With the blade member 24 still partially engaged by the blade receiving region 54 of the buckle portion 16, the handle member 36 pivots about the pivot pin 52, the pivot pin 52 moving from near the top of the blade member slot 32 as illustrated in FIG. 1 to the bottom of the slot 32 as the handle member 36 is pivoted from the position illustrated in FIG. 1 to the position illustrated in FIG. 3. As the blade member 24 and the handle member 36 approach the position illustrated in FIG. 3, the detent 42 of the locking arm 38 slides over a rounded portion 62 of the tang portion 28 and into engagement with the blade member recess 30. The knife portion 14 is now in its locked open position with the blade member 24 still engaged by the blade receiving region 54 of the buckle portion 16. The blade member 24 is then withdrawn from the blade receiving region 54, separating the knife portion 14 from the buckle portion 16, with the blade member 24 locked in its open position.

As will be apparent to those skilled in the art, the biasing spring 46 need not be a leaf spring as illustrated, but can comprise any suitable biasing element.

The principles, preferred embodiment and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. A belt buckle knife having in combination a knife portion removably accommodated by a buckle portion, said belt buckle knife comprising:

a buckle portion having first and second buckle face elements cooperating to define a blade receiving region, said buckle portion being adapted to engage and fasten a belt;

a knife portion having a handle member and a blade member selectively operable between (i) a knife closed position in which said blade member is engaged by said blade receiving region of the buckle portion and said knife portion is securely attached to said buckle portion, and (ii) a knife open position in which said blade member is locked open relative to said handle member and said knife portion is removable from said buckle portion, said handle member including first and second handle face elements; and structure to securely attach said knife portion to said buckle portion, said structure including:

locking arm structure included in said handle member of said knife portion and having a detent, said locking arm structure and said first and second handle face elements defining a slot-like region; and handle receiving structure included on said buckle portion and having a handle receiving recess, said handle receiving structure being accommodated by said slot-like region with said handle receiving recess engaging said detent when said knife portion is in the knife closed position.

2. The belt buckle knife according to claim 1, wherein said handle member further comprises biasing structure to urge said detent in engagement with said handle receiving recess.

3. The belt buckle knife according to claim 1, wherein said knife portion further comprises structure to lock said blade member open with respect to said handle member, said structure comprising:

tang structure included on said blade member and having a blade member recess, said blade member recess engaging said detent of the locking arm structure when said knife portion is in the knife open position.

4. The belt buckle knife according to claim 3, wherein said handle member further comprises biasing structure to urge said detent in engagement with said blade member recess.

5. The belt buckle knife according to claim 2 or claim 4 wherein said biasing structure comprises a spring member.

6. A belt buckle knife adapted to engage and fasten a belt and having in combination a knife structure removably accommodated by a buckle structure, said belt buckle knife comprising:

knife structure having:

a blade member including:

a blade portion; and a tang portion having a blade member recess and a blade member slot; and a handle member including:

first and second handle face elements spaced one from the other;

a first pivot pin on which said blade member slot is mounted;

a second pivot pin;

a locking arm mounted on said second pivot pin and having a detent, said locking arm and said first and second handle face elements defining a slot-like region; and biasing structure to urge said locking arm pivotally about said second pivot pin; and buckle structure having:

structure adapted to engage and fasten the belt;

first and second buckle face elements; and structure to engage said knife structure including:

a blade receiving region defined by said first and second buckle face elements; and a handle receiving region having a handle receiving recess;

the blade member being selectively pivotable about the first pivot pin of said handle member between (i) a knife closed position in which the blade receiving region of said buckle structure engages the blade member of said knife structure and the slot-like region of the handle member engages the handle receiving region of the buckle structure with the handle receiving recess of said buckle structure engaging the detent of the locking arm of said knife structure, and (ii) a knife open position in which the detent of the locking arm engages the blade member recess and the knife structure is removable from the buckle structure.

* * * * *

UNITED STATES PATENT AND TRADEMARK OFFICE

CERTIFICATE OF CORRECTION

PATENT NO. : 4,466,561

DATED : August 21, 1984

INVENTOR(S) : Richard L. Slaughter

It is certified that error appears in the above-identified patent and that said Letters Patent is hereby corrected as shown below:

On the title page, Item /73/ should read

-- /73/ Assignee Slaughter Knife Co., Inc., Texarkana, Tex. --.

Column 3, line 32, "handle slot-like region 37 of the" should read -- slot-like region 37 of the handle --.

Signed and Sealed this

*Twelfth* Day of *March 1985*

[SEAL]

*Attest:*

DONALD J. QUIGG

*Attesting Officer* *Acting Commissioner of Patents and Trademarks*